US005892419A

United States Patent [19]

Kotanen et al.

[11] Patent Number: 5,892,419

[45] Date of Patent: Apr. 6, 1999

[54] INTEGRAL RESONATORS FOR A FILTER AND A METHOD FOR MANUFACTURING THEREOF

[75] Inventors: Anssi Kotanen, Oulu; Markku Tiihonen, Oulunsalo, both of Finland

[73] Assignee: ADC Solitra Oy, Kempele, Finland

[21] Appl. No.: 678,763

[22] Filed: Jul. 11, 1996

[30] Foreign Application Priority Data

Sep. 26, 1995 [FI] Finland ..... 954562

[51] Int. Cl.[6] ..... H01P 1/20; H01P 1/213

[52] U.S. Cl. ..... 333/202; 333/134; 29/600

[58] Field of Search ..... 333/202, 203, 333/204, 126, 134; 29/600

[56] References Cited

U.S. PATENT DOCUMENTS

| | | | |
|---|---|---|---|
| 4,034,319 | 7/1977 | Olsson | 333/203 |
| 4,670,724 | 6/1987 | Riblet | 333/244 |
| 4,990,869 | 2/1991 | Chanteau et al. | 333/203 |
| 5,151,670 | 9/1992 | Blair et al. | 333/203 X |
| 5,225,799 | 7/1993 | West et al. | 333/202 |
| 5,278,528 | 1/1994 | Turunen | 333/203 |
| 5,352,996 | 10/1994 | Kawaguchi | 333/203 |
| 5,410,284 | 4/1995 | Jachowski | 333/202 |

FOREIGN PATENT DOCUMENTS

| | | | |
|---|---|---|---|
| 976056 | 3/1951 | France . | |
| 30 28 925 | 2/1982 | Germany | 333/134 |
| 59-122201 | 7/1984 | Japan | 333/134 |
| 0294302 | 12/1987 | Japan | 333/134 |
| 6-291512 | 10/1994 | Japan | 333/203 |
| 732507 | 6/1955 | United Kingdom . | |
| 1421311 | 1/1976 | United Kingdom . | |
| 1442227 | 7/1976 | United Kingdom . | |
| 9222101 | 10/1992 | WIPO . | |

*Primary Examiner*—Seungsook Ham
*Attorney, Agent, or Firm*—Ladas & Parry

[57] ABSTRACT

The invention relates to a filter, a method for manufacturing a filter, a resonator construction, and a method for manufacturing a resonator construction. The filter comprises a shell construction and a plurality of resonators mounted in the shell construction for forming a multi-circuit filter. The filter comprises a connecting portion which combines the resonators and is integral with the resonators.

17 Claims, 3 Drawing Sheets

INTEGRAL RESONATORS FOR A FILTER AND A METHOD FOR MANUFACTURING THEREOF

Figure 1:
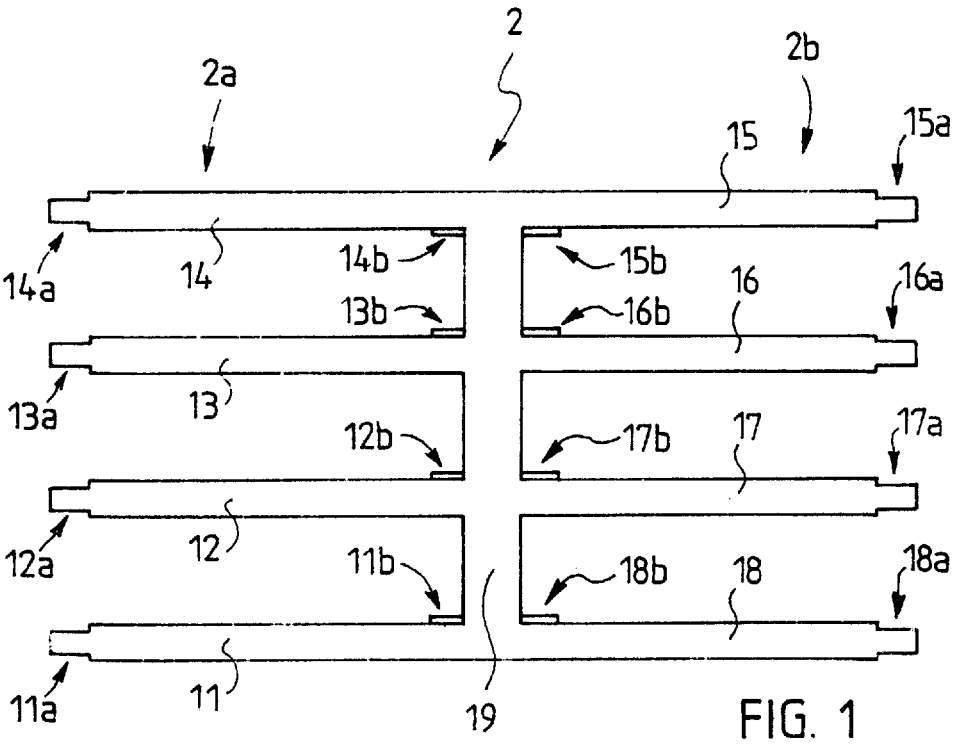

The invention relates to a filter comprising a shell construction and a plurality of resonators mounted in the shell construction for forming a multi-circuit filter.

The invention also relates to a method for manufacturing a filter, wherein a plurality of resonators are mounted in a shell construction for forming a multi-circuit filter.

The invention further relates to a resonator construction comprising a plurality of resonators.

The invention also relates to a method for manufacturing a resonator construction comprising a plurality of resonators.

Resonator constructions are used for implementing high-frequency circuits, for instance in base stations of mobile phone networks. Resonators can be used, for example, as interface and filtering circuits in the amplifiers of transmitter and receiver units in base stations.

There are several different types of resonator filters comprising a shell construction, or body, e.g. coaxial resonator filters and L-C filters. The present solution pertains particularly to these types. In addition, for instance a helix resonator and a cavity resonator construction are known. All these resonator types comprise a metallic shell construction. In coaxial resonators, for example, the shell envelops a conductor which is positioned in the middle of the shell and which can be called, for example, a resonator or a resonator pin.

For instance high-frequency filters, particularly more complicated filters, employ a multi-cavity shell construction and so-called sub-band division. In this case the resonator construction has a multi-cavity shell construction, i.e. it comprises a plurality of resonator cavities, each of which forms a separate resonant circuit with the corresponding resonator pin. In a multi-cavity resonator construction, the resonant circuits are coupled to one another in such a manner that the resonator construction provides the desired frequency response in the frequency band. Each resonant circuit is coupled to the following resonant circuit in the switching diagram.

At present, resonators, or resonator pins, are manufactured one at a time by cutting them from a metal bar with a lathe. The resonators are positioned one by one on the bottom of the shell construction and secured thereto by screwing and/or soldering. This is an expensive and time-consuming solution, as the resonators are mounted in the shell one by one. It also takes a long time to tune the filter, since the resonators are not sufficiently similar to each other in their mechanical structure.

The object of the present invention is to provide a new type of filter, a method for manufacturing it, a resonator, and a method for manufacturing it which avoid the problems associated with the known solutions.

The object is achieved with a filter of the invention, which is characterized in that the filter comprises a connecting portion combining the resonators, said connecting portion being integral with the resonators.

The object is achieved with a method of the invention for manufacturing a filter, which is characterized in that the resonators of the filter are made as one or more resonator packages in which the resonators are integral with each other, and the resonators are mounted in the shell construction as one or more such resonator packages.

The object is achieved with a resonator construction of the invention, which is characterized in that it comprises a connecting portion combining the resonators, said connecting portion being integral with the resonators.

The object is achieved with a method of the invention for manufacturing a resonator construction, which is characterized in that the resonators are formed as one or more integral resonator packages in such a manner that the resonators of a resonator package are integral with each other, and a connecting portion combines the different resonators.

The solution of the invention has several advantages. The expensive and time-consuming lathing of the resonator pins can be replaced with more rapid and less expensive techniques, such as punching or injection molding. The filters can be assembled more rapidly and reliably, because resonators do not have to be mounted separately, and because comb-shaped sets of resonators are used in the invention. In addition, the filter tuning times are shortened, since the resonators are more similar to each other in their mechanical structure. The advantages are particularly obvious in the preferred embodiments of the invention.

Figure 2:
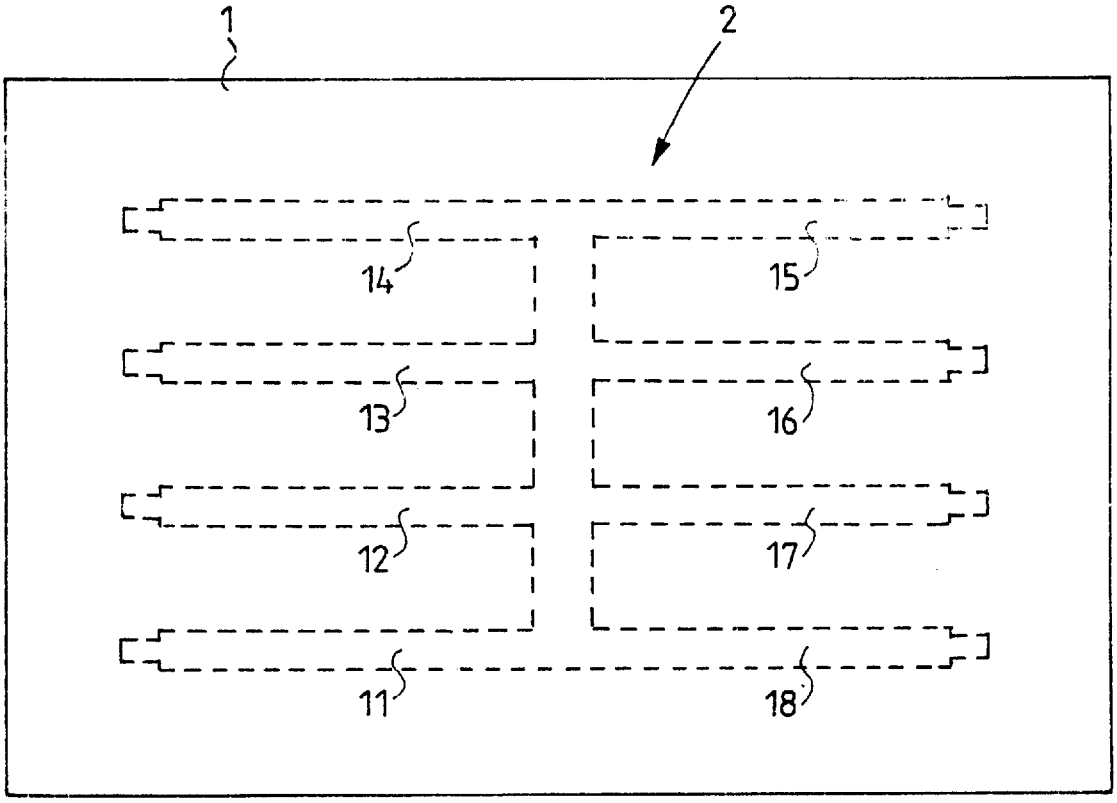
Figure 3:
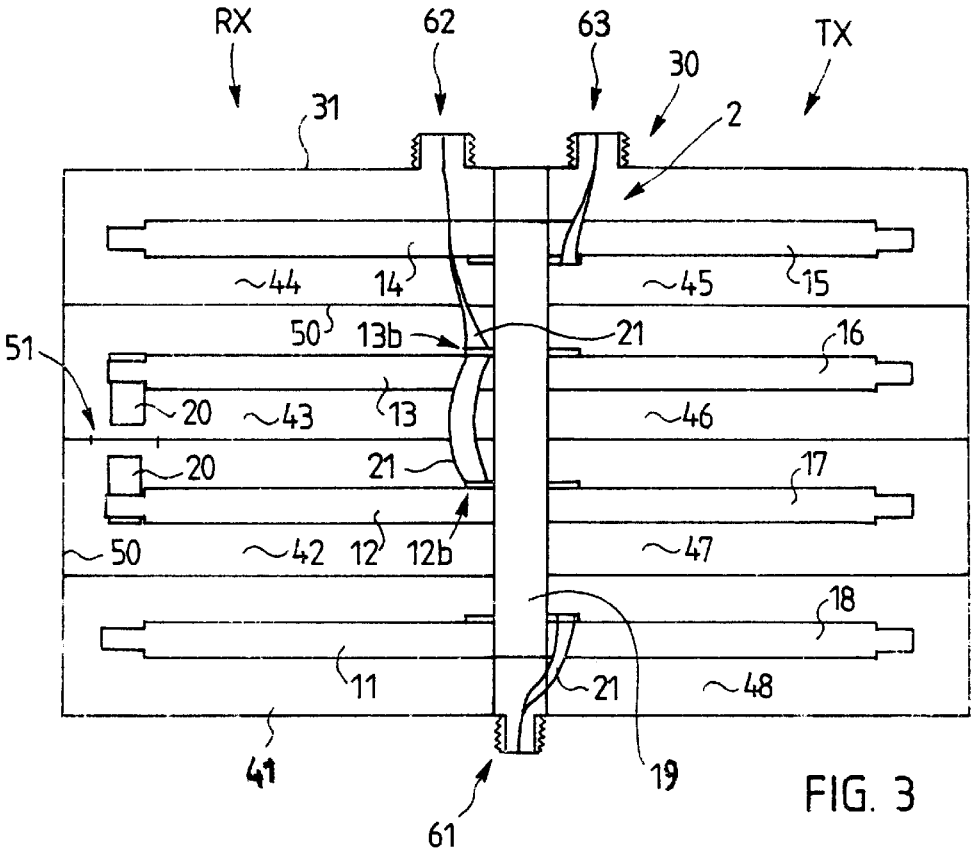
Figure 4:
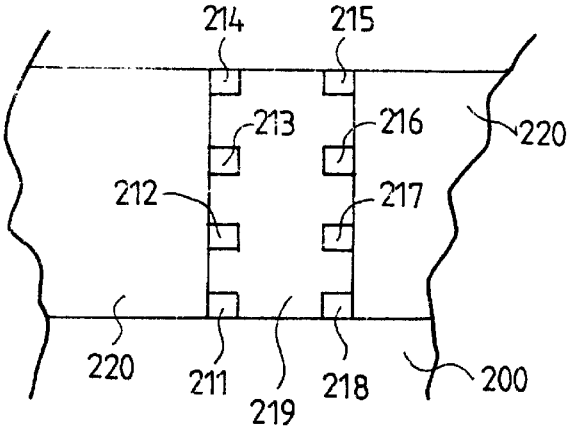
Figure 5:
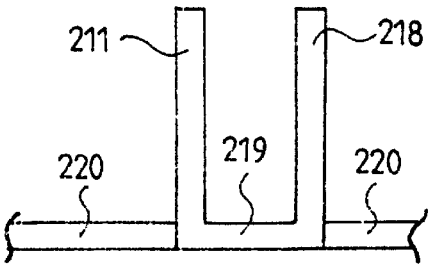
Figure 6:
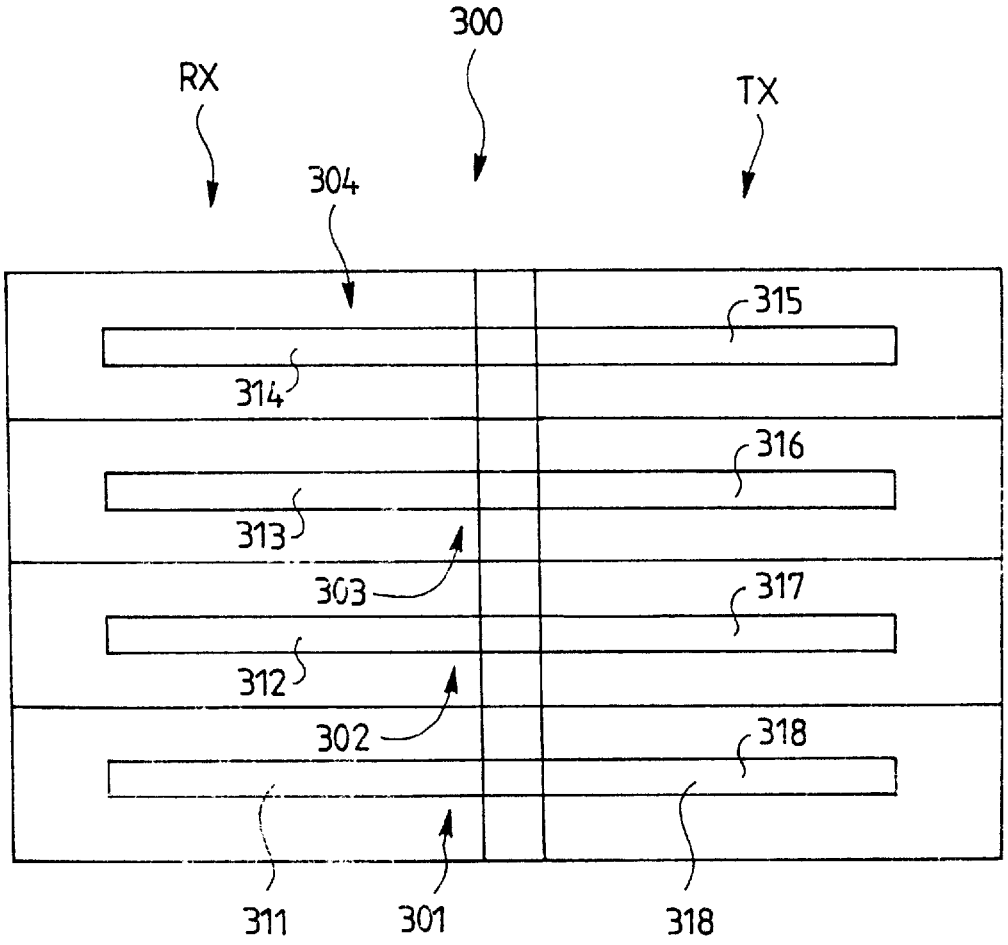

In the following, the invention will be described in greater detail with reference to the accompanying drawings, in which FIG. 1 shows a resonator construction, FIG. 2 shows a sheet blank, of which a resonator structure can be formed, FIG. 3 shows a filter, FIG. 4 is a top view of a second embodiment of the invention, FIG. 5 is a side view of the second embodiment of FIG. 4, FIG. 6 shows a third embodiment of the invention.

FIG. 2 shows a steel sheet blank 1 of e.g. 3 mm, from which a resonator construction 2 according to FIG. 1 has been removed by punching, for example. In FIG. 2, the resonator construction 2 to be removed from the blank 1 by punching is indicated by a broken line. The resonator construction illustrated in FIG. 2 comprises a plurality of resonators 11–18, and a connecting portion 19 integral with the resonators 11–18. The resonator construction is thus made in one piece of a steel sheet 2 or another integral piece 2 of material. The Applicant has found punching from a metal sheet 2 to be a preferred technique, but in another preferred embodiment another technique may be used, e.g. compression molding of a ceramic material, die casting, or injection molding. Instead of metal, it is also possible to use, for example, plastic, ceramic or some other machineable material. It is also possible to use several materials in one resonator comb, but even then the result is an integral piece of material, comprising resonators 11–18 and a connecting portion 19.

In a preferred embodiment, the connecting portion 19 and the resonators 11–18 form a comb-shaped resonator construction 2 comprising at least one and preferably at least two sets 2*a*, 2*b* of resonator pins, which are preferably planar in such a way that the resonator pins 11–14 are substantially on the same plane, and resonator pins 15–18 are substantially on the same plane, and most preferably in such a way that sets 2*a* and 2*b* of resonator pins are both substantially on the same plane. The planar shape of the resonator construction facilitates the manufacture. All the resonators 11–18 and the connecting portion 19 of the resonator construction are thus preferably planar. However, in some embodiments, the planar sets 2*a* and 2*b* are not on the same plane but are, for example, superimposed, substantially parallel planes, in which case the resonator construction, indicated by number 200, could be e.g. U-shaped as shown in FIGS. 4 and 5. In this case, the resonator comb is made or bent in such a way that the resonators on both sides are substantially parallel to each other. The shape of the resonator comb 2 or 200 can also be different from what is illustrated in FIGS. 1 to 5, but the Applicant has found the embodiments shown in the figures to be the most useful. According to the second preferred embodiment of the invention, shown in FIGS. 4 and 5, such a structural element 219 is formed simultaneously with the manufacture of the actual resonator package 200 that is integral with the resonators 211–218 and that forms at least part of the resonator shell construction, preferably of the bottom 220 of the shell construction. The bottom of the shell construction thus comprises parts 219 and 220. This embodiment facilitates the manufacture of the shell construction and the assembly of the filter.

In a preferred embodiment of the invention, at least some of the resonators 11–18 comprise a positioning part 11*a*–18*a* for coupling members 20 to be connected to the resonators 11–18 or for other supplementary parts. The coupling members 20 can be seen in FIG. 3, which illustrates a coaxial resonator filter 30. The filter 30 comprises a shell construction 31 and a plurality of resonators 11–18 mounted in the shell construction for forming a multi-circuit filter 30. The shell construction 31 comprises sections 41–48 defined by a wall construction 50. Said coupling members 20 are provided in areas between certain resonators in such a way that they are attached to one resonator and extend through an opening 51 in the wall construction 50 towards another resonator. The area between resonators 12 and 13, for instance, is provided with two coupling members 20 each of which is attached to one of the resonators 12 and 13 and extends towards the other one of the resonators 13 and 12 through an opening 51 in the wall 50. The members 20 adjust the coupling between the resonators to a suitable level.

The filter 30, i.e. in practice the resonator construction 2, comprises a connecting portion 19 combining the resonators. This connecting portion 19 and the resonators 11–18 are made in one piece. The resonators of the filter 30 preferably form a comb-shaped resonator construction 2. The resonator comprises connectors 61–63, of which connector 61 is an interface from the antenna, e.g. the antenna of a base station, connector 62 is an RX interface, from which a signal to the receiver of the base station is received, and connector 63 is a TX interface, to which a signal from the transmitter of the base station is supplied. In addition to a base station of a cellular radio network, the present invention can also be applied to other radio transceivers.

According to a preferred embodiment of the invention, the resonator comprises a positioning part 11*a*–18*a* for a coupling member 20 at the upper end of the resonator and/or a positioning part 11*b*/18*b* for a coupling member 21 at the lower end of the resonator. The coupling member 21 can be, for example, a strip-like conductor, by means of which a direct galvanic connection is provided between certain connectors 61–63 and certain resonators to allow a signal to be transferred. FIG. 3 shows by way of example a connection strip 21 from the resonators 13 and 14 to the RX connector 62. The positioning parts 11*a*–18*a* and 11*b*–18*b* form a kind of cog or a similar construction, which allows the coupling members 20 and 21 to be more easily and reliably mounted in the desired position.

In the filter of the invention, the resonators 11–14 and correspondingly 15–18 are preferably substantially on the same plane as the adjacent resonators. In this case, the space utilization, manufacture and assembly of the resonator are optimal.

A further object of the invention is a method for manufacturing a filter 30, wherein a plurality of resonators 11–18 are mounted in the shell construction 50 of the filter 30 for forming a multi-circuit filter. It is an essential feature that the resonators 11–18 of the filter are manufactured as one or more resonator packages 2 in which the resonators 11–18 are made in one piece, and that the resonators 11–18 are mounted in the shell construction 50 as one or more such resonator packages 2, which facilitates the manufacture and assembly of the filter 30.

FIGS. 1 to 3 illustrate a duplex filter with eight resonator pins: both the RX filter and the TX filter comprise four resonators 11–14 and 15–18. In a possible embodiment (not shown) the resonator construction 2 may include, for example, two resonator packages 2 according to FIG. 1; this makes it possible to implement a duplex filter where both the TX filter and the RX filter comprise eight resonator circuits.

The invention further relates to a method for manufacturing a resonator construction 2 comprising a plurality of resonators 11–18. According to this method, the resonators 11–18 are formed as one or more integral resonator packages in such a way that the resonators of one resonator package are made in one piece with a connecting portion combining the different resonators.

Resonators of different lengths are used to provide the desired frequency response. In the examples illustrated in the figures, the lengths of the resonators vary to a small extent. The shortest resonator is resonator 16, which is 3.5 mm shorter than the longest resonator 11. The length of the resonators may vary from 32.5 to 36 mm, for example. According to a preferred embodiment, resonators 11–18 of several different lengths are formed in the same resonator package, and the lengths of the resonators are determined during the manufacture of the resonator package, e.g. in the punching step or injection molding step. This embodiment facilitates the manufacture.

As stated above, according to a preferred embodiment, the resonators 11–18 in the resonator construction or part of them comprise one or more positioning parts 11*a*–18*a* or 11*b*–18*b* for a coupling member such as 20 or 21. According to the preferred embodiment, the method for manufacturing the resonator construction 2 thus comprises providing, simultaneously with the manufacture of the resonator package 2, one or more resonators 11–18 in the resonator package 2 with positioning parts 11*a*–18*a*, 11*b*–18*b* for a coupling member such as 20 or 21. This embodiment facilitates the manufacture, since these parts are formed at the same time as the actual resonator construction 2, 11–19 is made by, for example, punching.

FIG. 6 illustrates a third embodiment of the invention. This is the most simplified embodiment. The filter 300 of FIG. 6 has a resonator construction 301 comprising at least two resonators 311 and 318. In accordance with the basic idea, the resonators, such as resonators 311 and 318, are integral, preferably parts of the same pin which is preferably cut with a lathe. In this solution, the resonator construction 301 is preferably a continuous bar-like resonator construction 301, 311, 318, where the resonators 311, 318 are at the different ends of the bar. In practice, FIG. 6 shows four resonator constructions 301–304, which together form a larger resonator construction comprising four two-part pins 301–304 with resonators 311–318. This embodiment is also advantageous in view of the manufacture of the resonator construction and the assembly of the filter, since the resonators are packages of two resonators.

The resonator construction 2 according to the preferred embodiment shown in FIG. 3 is integral and comprises resonators 11–14 for a receiver filter block RX and resonators 15–18 for a transmitter filter block TX. Correspondingly, the resonator construction 301 according to FIG. 6 is integral and comprises a resonator 311 for a receiver filter block RX and a resonator 318 for a transmitter filter block TX. This facilitates the manufacture.

Although the invention has been described above with reference to the examples illustrated in the accompanying drawings, it will be clear that the invention is not restricted to these examples but can be modified in many ways within the inventive concept disclosed in the appended claims.

We claim:

1. In a multi-circuit filter comprising a shell construction and a plurality of resonators mounted in the shell construction for forming the multi-circuit filter, the improvement comprising:

a connecting portion combining two sets of the resonators by being one-piece with the resonators of the two sets, the resonators of the two sets extending from respective sides of the connecting portion, wherein the two sets of the resonators and connecting portion have a comb shape and wherein all of the resonators extend from the connecting portion.

2. The filter according to claim 1, wherein the two sets of the resonators are substantially on a plane.

3. In a method for manufacturing a multi-circuit filter comprising a plurality of resonators in a shell construction, th e improvement wherein:

sets of the resonators are one-piece in a resonator package by extending in comb shape from respective sides of a connecting portion for mounting in the shell construction as the resonator package and wherein all of the resonators extend from the connecting portion.

4. A resonator construction comprising:

a plurality of resonators and a connecting portion, the connecting portion being one-piece with the resonators and having sets of the resonators extending from respective sides of the connecting portion, wherein the connecting portion and the resonators have a comb shape and wherein all of the resonators extend from the connecting portion.

5. The resonator construction according to claim 4, wherein the resonators and connecting portions are planar.

6. The resonator construction according to claim 4, wherein at least two of the resonators have respective positioning parts for coupling members to be attached thereto.

7. The resonator construction according to claim 4, wherein the positioning parts are at ends of the resonators to which the resonators extend from the connecting portion.

8. A method for manufacturing a resonator constructions comprising:

forming a plurality of resonators as two resonator packages integral with a connecting portion, the resonators of the two resonator packages extending from respective sides of the connecting portion, wherein the resonators of at least one of the resonator packages have several different lengths formed during the forming of the resonator packages.

9. The method according to claim 8, wherein one or more resonators are provided, simultaneously with the forming of the resonator packages, with positioning parts for a coupling member.

10. The method according to claim 8, wherein the forming further comprises forming a structural element that is integral with the resonators for at least part of a shell construction for the resonators.

11. The method according to claim 8, wherein the forming of the resonator packages comprises punching from a metal sheet.

12. The resonator construction according to claim 4, wherein the sets of the resonators are respectively positioned for a transmitter filter block and a receiver filter block.

13. The resonator construction according to claim 4, wherein the sets of the resonators respectively extend in different directions.

14. The resonator construction according to claim 4, wherein the sets of the resonators respectively extend in opposite directions.

15. The resonator construction according to claim 4, wherein the sets of the resonators respectively extend in the same direction.

16. The filter according the claim 1, wherein a wall of the shell construction separates at least two of the resonators from each other.

17. The filter according to claim 16, wherein the at least two of the resonators are of one of the two sets of the resonators.

* * * * *